US006561313B2

(12) United States Patent
Hewlett et al.

(10) Patent No.: US 6,561,313 B2
(45) Date of Patent: May 13, 2003

(54) BELAY/RAPPEL DEVICE FOR USE IN CLIMBING ACTIVITIES AND THE LIKE

(75) Inventors: Michael Hewlett, Boulder, CO (US); Kristopher Boldt, Boulder, CO (US)

(73) Assignee: Trimorphics, Inc., Boulder, CO (US)

( * ) Notice: Subject to any disclaimer, the term of this patent is extended or adjusted under 35 U.S.C. 154(b) by 0 days.

(21) Appl. No.: 10/101,107

(22) Filed: Mar. 19, 2002

(65) Prior Publication Data

US 2003/0034203 A1 Feb. 20, 2003

Related U.S. Application Data

(60) Provisional application No. 60/313,037, filed on Aug. 16, 2001.

(51) Int. Cl.[7] ..... A47L 3/04; A62B 1/20

(52) U.S. Cl. ..... 182/5; 182/193; 188/65.1

(58) Field of Search ..... 182/5, 6, 7, 192, 182/193, 191, 3, 72; 188/65.5, 65.1, 65.2, 65.4; 254/389, 390, 391, 405

(56) References Cited

U.S. PATENT DOCUMENTS

| | | | | | |
|---|---|---|---|---|---|
| 200,387 | A | | 2/1878 | Garoutte | |
| 284,627 | A | | 9/1883 | Goble | |
| 290,254 | A | | 12/1883 | McCandliss | |
| 3,814,210 | A | * | 6/1974 | Hoffman | 182/6 |
| 3,852,943 | A | * | 12/1974 | Healy | 182/5 X |
| 4,027,748 | A | | 6/1977 | Persson | |
| 4,184,567 | A | | 1/1980 | Rabelos | |
| 4,337,553 | A | * | 7/1982 | Fischer | 254/391 X |
| 4,508,193 | A | * | 4/1985 | Forrest | 182/5 |
| 4,580,658 | A | * | 4/1986 | Brda | 182/5 |
| 4,588,045 | A | | 5/1986 | Walker, Sr. | |
| 4,678,059 | A | * | 7/1987 | Bowker | 182/5 |
| 4,919,231 | A | | 4/1990 | Klokseth | |
| 4,923,037 | A | * | 5/1990 | Stephenson et al. | 188/65.1 X |
| 5,511,291 | A | | 4/1996 | Crawford | |
| 5,850,890 | A | * | 12/1998 | Couttet | 182/5 |
| 5,855,251 | A | * | 1/1999 | Deuer | 182/5 |
| 5,860,493 | A | * | 1/1999 | Cherpitel | 182/193 X |
| 5,924,522 | A | * | 7/1999 | Ostrobrod | 182/191 |
| 5,975,243 | A | | 11/1999 | Lorbek | |
| 6,009,977 | A | * | 1/2000 | Pelofi | 182/192 |
| 6,029,777 | A | | 2/2000 | Rogelja | |
| 6,085,866 | A | * | 7/2000 | Kowalewski | 182/5 |
| 6,095,502 | A | * | 8/2000 | Dodge, Jr. | 182/5 X |
| 6,378,650 | B2 | * | 4/2002 | Mauthner | 182/5 |
| 6,382,355 | B1 | * | 5/2002 | Kowalewski | 182/193 X |
| 6,446,936 | B1 | * | 9/2002 | Ostrobrod | 254/368 |

FOREIGN PATENT DOCUMENTS

| | | | | |
|---|---|---|---|---|
| GB | 2256673 | * | 12/1992 | 182/5 |

* cited by examiner

*Primary Examiner*—Daniel P. Stodola
*Assistant Examiner*—Hugh B. Thompson
(74) *Attorney, Agent, or Firm*—Emery L. Tracy

(57) ABSTRACT

A device for controlling movement along at least one rope. The belay/rappel device comprises a main body having an open first end and an open second end. A rope securement mechanism adjacent the open second end retains the looped portion of the rope with the rope slidable about the rope securement mechanism and the first rope strand and the second rope strand extending through the open first end. A carabiner is received within at least one carabiner opening formed in the main body with the first rope strand being positioned between the carabiner and the main body. The main body is rotatable to a released position allowing the rope to slide about the rope securement mechanism through the main body and upon release of the main body and automatically rotatable to a locked position with the carabiner pinching the first rope strand against the main body inhibiting movement of the rope relative to the main body.

20 Claims, 9 Drawing Sheets

Fig. 5
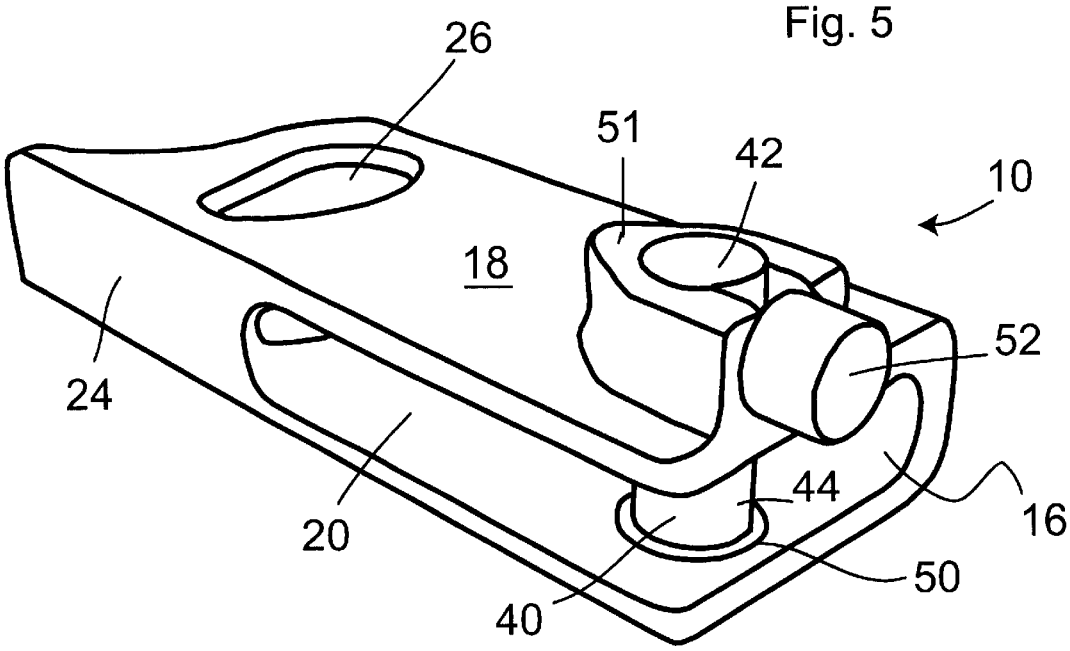
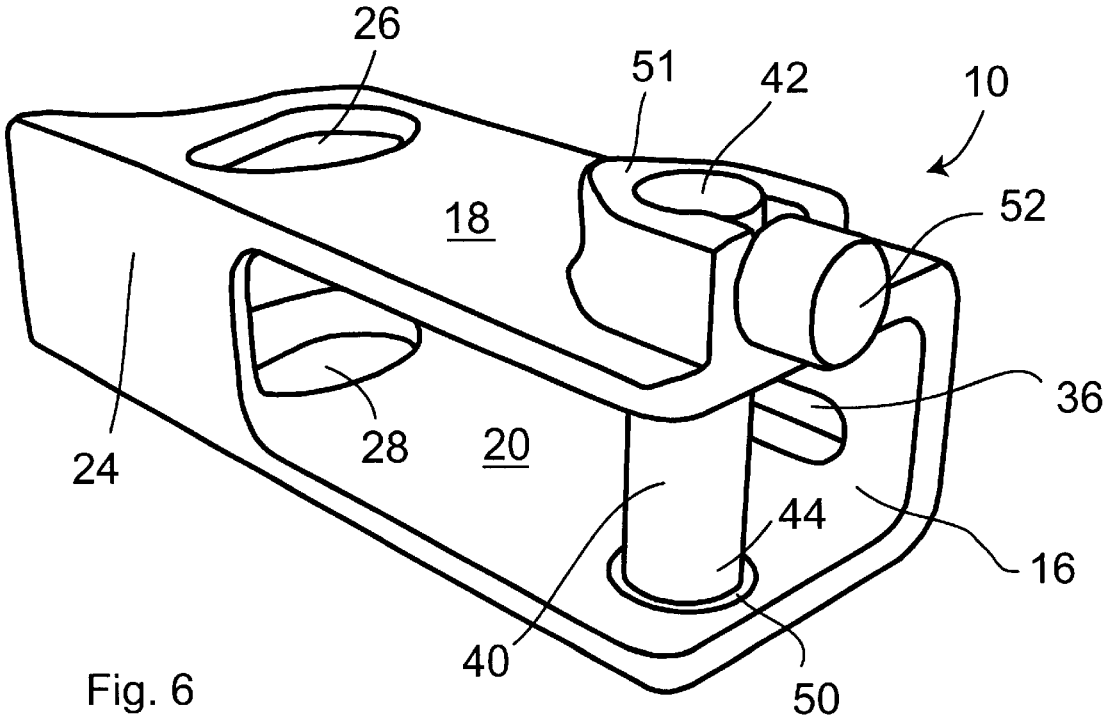
Fig. 6

Fig. 7
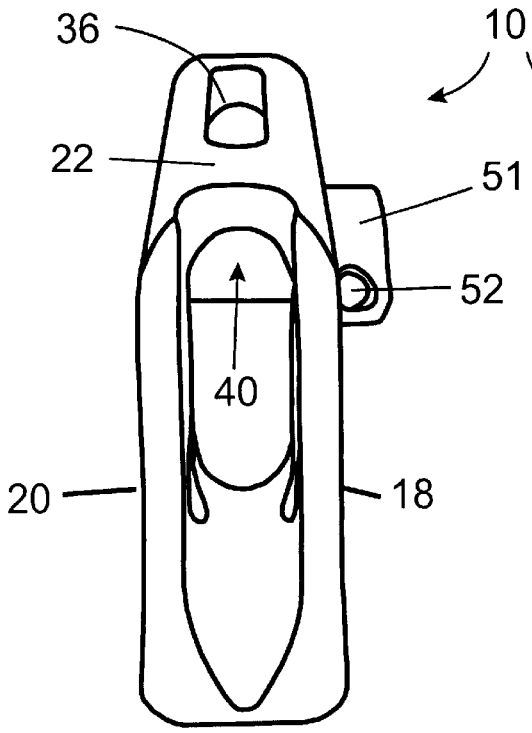
Fig. 8
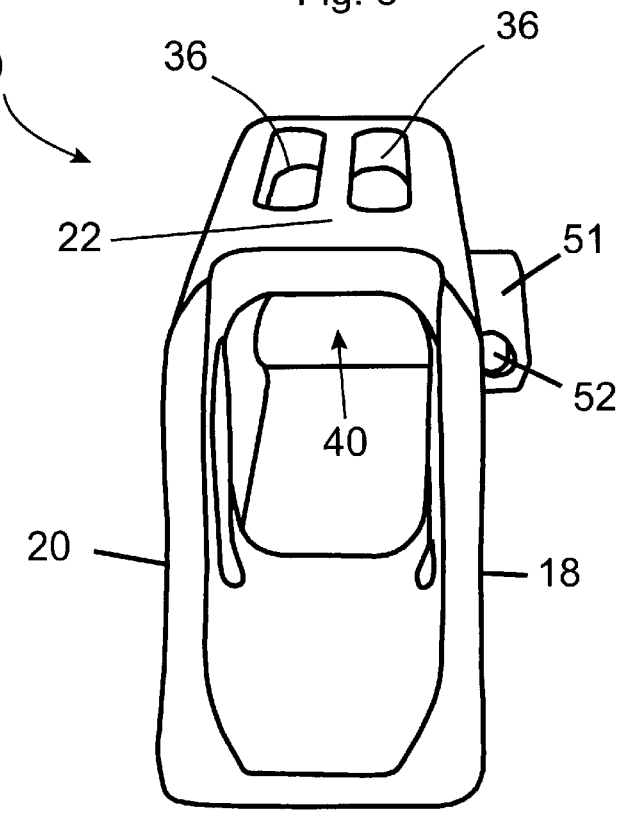
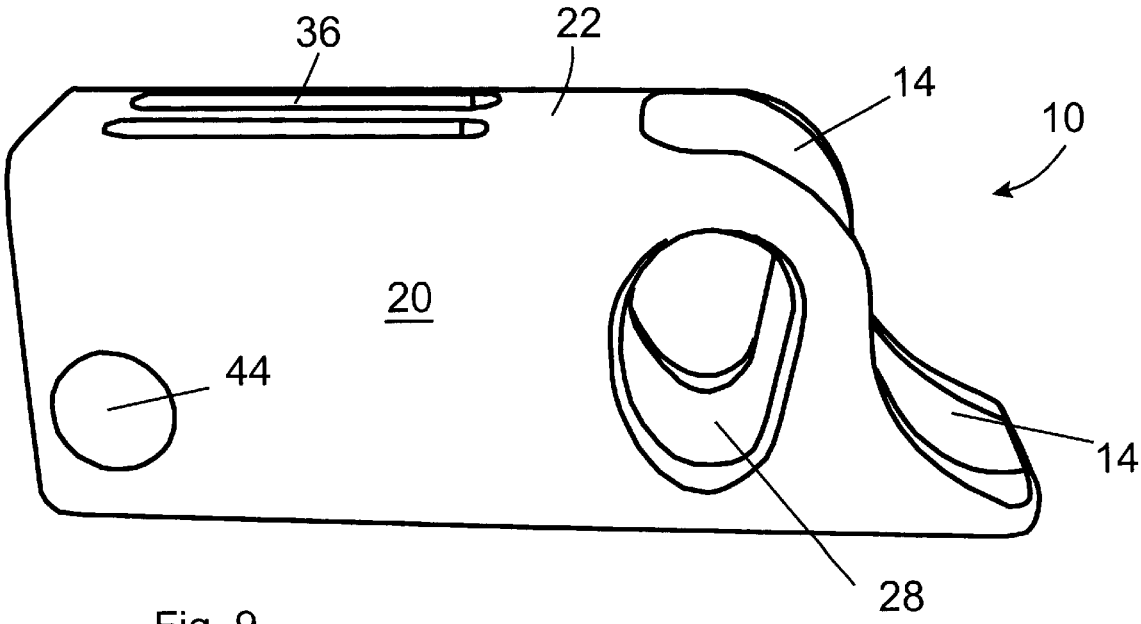
Fig. 9

Fig. 10
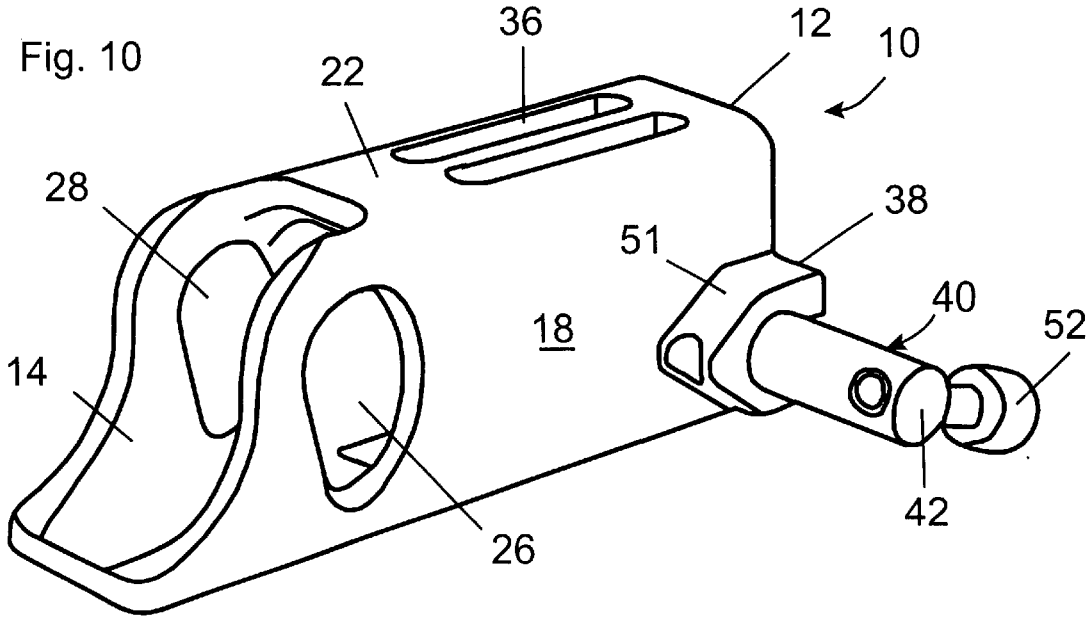
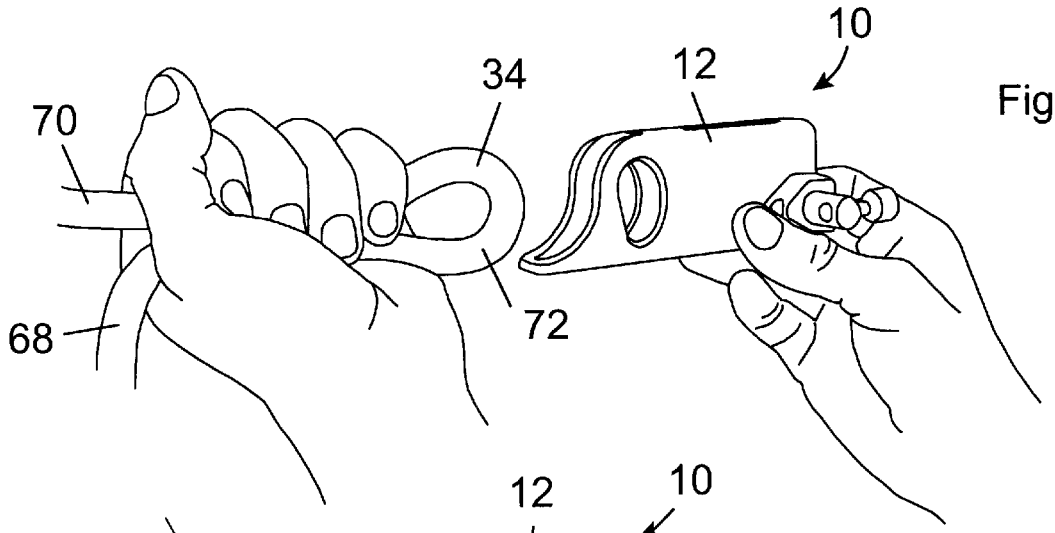
Fig. 11
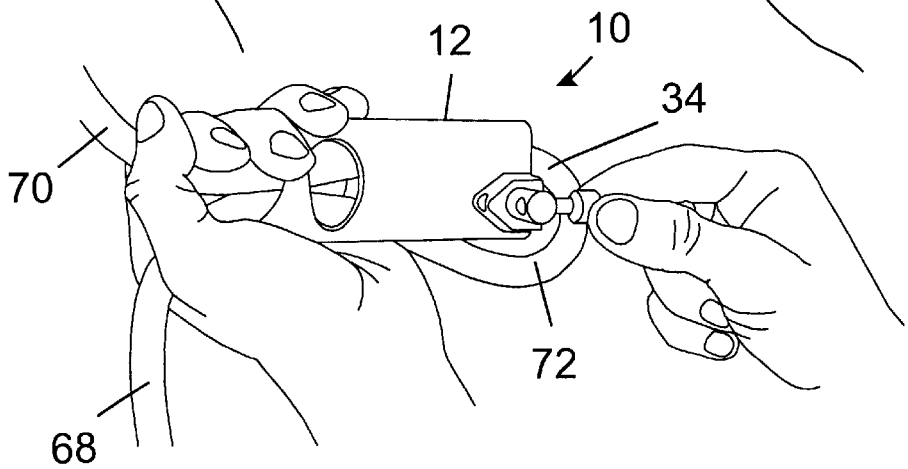
Fig. 12

Fig. 17
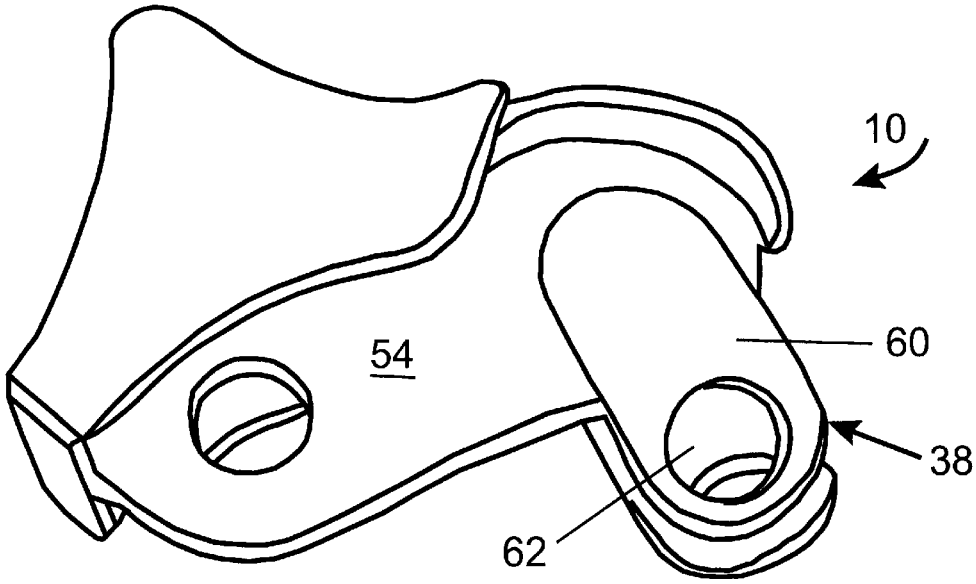
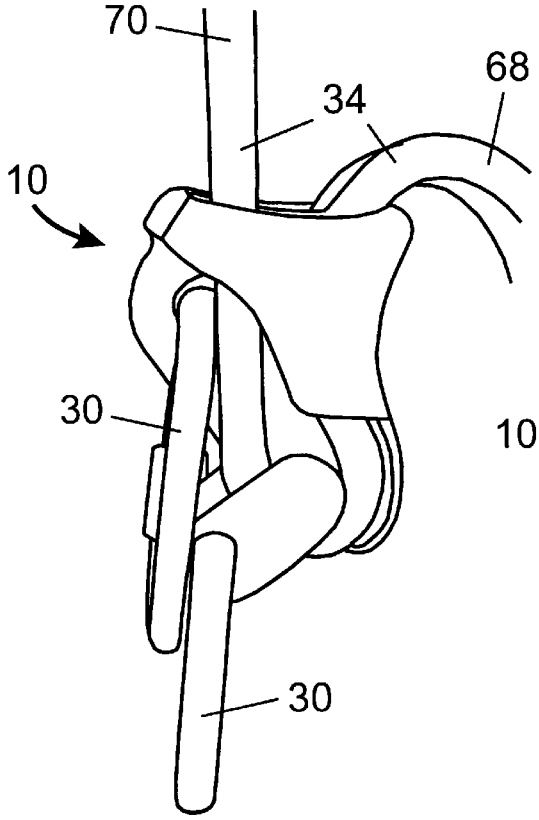
Fig. 18
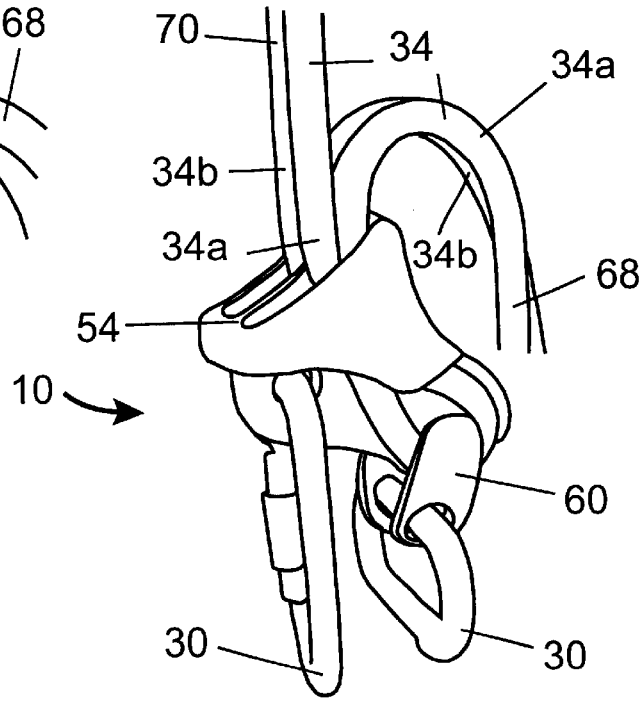
Fig. 19

BELAY/RAPPEL DEVICE FOR USE IN CLIMBING ACTIVITIES AND THE LIKE

The present application is a continuation of provisional patent application Ser. No. 60/313,037, filed on Aug. 16, 2001, entitled "Self-Locking Belay Rappel Device".

BACKGROUND OF THE INVENTION

1. Field of the Invention

This invention relates generally to belay and rappel devices for use in climbing activities and, more particularly, it relates to a belay/rappel device usable in climbing activities and having an automatic locking position which self locks when the belay/rappel device is released thereby providing additional safety during ascents and controlled descents.

2. Description of the Prior Art

Belay/rappel devices are commonly used by climbers and others during climbing activities such as mountaineering, rock climbing, safety descents during emergencies and rescues, etc. In fact, almost any climber or other using a rope during climbing activities uses a belay/rappel device or similar device. Many of the conventional belay/rappel devices require one hand to stop or slow the rope of the climber so that the climber can descend in a safe and controlled manner.

While conventional self-locking belay/rappel devices will stop or slow the descent of the climber, they are typically heavy and have many moving parts associated therewith. Unfortunately, conventional locking belay/rappel devices require the load to be applied rapidly for the belay/rappel device to work in a proper and safe manner. Furthermore, due to the amount of equipment climbers are required to carry, lighter and stronger belay/rappel devices are preferred better.

One commonly used conventional belay/rappel device is the figure eight configuration belay/rappel device. The figure eight belay/rappel device operates by inserting a rope into a loop and over one more loop. The crossing of the ropes take up most of the friction thereby leaving the climber's brake hand the ability to stop the rope with ease. While the figure eight configuration device is sufficient in most instances since it is light and strong, the figure eight configuration device is non-locking. If the climber happened to release the rope with the brake hand for any reason, the climber will certainly fall risking injury or even death.

There are very few auto-locking belay/rappel devices available. The devices that exist typically have a cam mechanism or a wedge that is engaged against the rope when a sudden force is exerted on the rope by the climber. Others involve a series of pulleys or wheels that create friction to slow the rope.

Over time and use, many auto-locking belay/rappel devices become loose from the movement of all the parts. To ensure optimal performance, the devices need to be cleaned regularly and oiled occasionally to ensure that the device works properly. Currently, there are no fully auto-locking belay/rappel devices that work with two ropes.

Most climbers are not comfortable with complicated belay/rappel devices and typically choose simple belay/rappel devices that have no moving parts and rely on the operator to stop the fall by gripping the rope in cooperation with the device that slows the force of the rope through friction. Furthermore, the simple devices are easier to feed the lead climber rope and take up slack rapidly than conventional auto-locking belay/rappel devices. These are the basic functions of a belay/rappel device and are critical in times of a fall or difficult situation that requires attentive rope handling by the belay/rappel device operator.

Accordingly, there exists a need for a belay/rappel device for use in climbing activities which self-locks if released by the climber. Additionally, a need exists for a belay/rappel device for use in climbing activities which incorporates no moving parts. Furthermore, there exists a need for a belay/rappel device for use in climbing activities which can accommodate one or more ropes.

SUMMARY

The present invention is a device for controlling movement along at least one rope. The rope is foldable to form a first rope strand, a second rope strand, and a folded portion between the first rope strand and the second rope strand. The belay/rappel device comprises a main body having an open first end and an open second end. A rope securement mechanism adjacent the open second end retains the looped portion of the rope with the rope slidable about the rope securement means and the first rope strand and the second rope strand extending through the open first end. A carabiner is received within at least one carabiner opening formed in the main body with the first rope strand being positioned between the carabiner and the main body. The main body is rotatable to a released position allowing the rope to slide about the rope securement means through the main body and upon release of the main body and automatically rotatable to a locked position with the carabiner pinching the first rope strand against the main body inhibiting movement of the rope relative to the main body.

Additionally, the present invention includes a climbing system for controlling the ascent and descent of a climber. The climbing system comprises at least one rope and at least one carabiner. A frame member having at least one opening receives the carabiner with the frame member rotatable from a locked position to a released position. A pin extends from the frame member with each rope looped about the pin wherein in the locked position with each rope is restrained between the carabiner and the frame member and in the released position, each rope is free to move through the frame member about the pin, the frame member automatically rotating to the locked position upon release of the frame member.

The present invention further includes a method for inhibiting a climber from falling during a climbing activity. The method comprises providing at least one rope, providing at least one carabiner, providing a belay/rappel device, securing a looped portion of the rope the belay/rappel device with the rope slidable through the belay/rappel device, attaching the carabiner to the belay/rappel device over the rope, applying a force to the carabiner in a direction generally away from the belay/rappel device, locking movement of the rope through the belay/rappel device with the carabiner, rotating the belay/rappel device thereby moving the position of the carabiner relative to the rope and allowing the rope to slide through the belay/rappel device, and releasing the belay/rappel device to automatically rotate the belay/rappel device thereby locking movement of the rope through the belay/rappel device.

BRIEF DESCRIPTION OF THE DRAWINGS

FIG. 5 is another rear perspective view illustrating the belay/rappel device of FIG. 1, constructed in accordance with the present invention, for use with a single rope;

FIG. 6 is another rear perspective view illustrating the belay/rappel device of FIG. 2, constructed in accordance with the present invention, for use with a double rope;

FIG. 7 is a front view illustrating the belay/rappel device of FIG. 1, constructed in accordance with the present invention, for use with a single rope;

FIG. 8 is a front view illustrating the belay/rappel device of FIG. 2, constructed in accordance with the present invention, for use with a double rope;

FIG. 9 is an elevational side view illustrating the belay/rappel device of FIG. 2, constructed in accordance with the present invention, for use with a double rope;

FIG. 10 is a perspective view illustrating the belay/rappel device of FIG. 2, constructed in accordance with the present invention, for use with a double rope;

FIG. 11 is a perspective view illustrating the belay/rappel device of FIG. 1, constructed in accordance with the present invention, with the rope being inserted into the belay/rappel device;

FIG. 12 is a perspective view illustrating the belay/rappel device of FIG. 1, constructed in accordance with the present invention, with the rope being releasably secured within the belay/rappel device;

FIG. 17 is a perspective view illustrating yet another embodiment of the belay/rappel device, constructed in accordance with the present invention;

FIG. 18 is a side view illustrating the belay/rappel device of FIG. 17, the device being in the released position;

FIG. 19 is a side view illustrating the belay/rappel device of FIG. 17, the device being in the locked position.

DETAILED DESCRIPTION OF THE PREFERRED EMBODIMENTS

Figure 1:
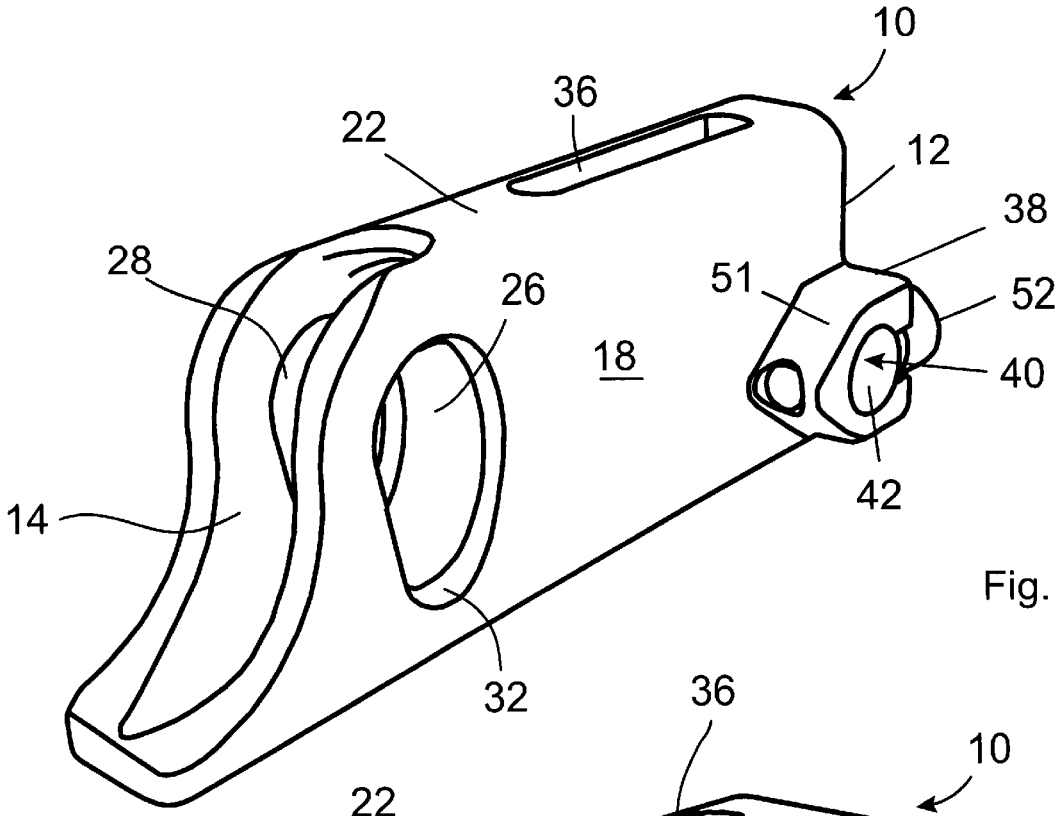
FIG. 1 is a front perspective view illustrating a belay/rappel device, constructed in accordance with the present invention, for use with a single rope.

As illustrated in FIGS. 1–10, the present invention is a belay/rappel device, indicated generally at 10, for use in climbing activities and the like. The belay/rappel device 10 of the present invention automatically moves from a released position to a locked position and can be used by climbers and others during any type of climbing activity including, but not limited to, mountaineering, rock climbing, safety descents during emergencies and rescues, etc. Furthermore, in addition to climbing activities, the belay/rappel device 10 can be used in sailing for rigging for sails and sailboats. Other uses are also within the scope of the present invention.

The belay/rappel device 10 includes a main body 12 having an open front end 14, an open back end 16 opposite the front end 14, a first side wall 18, a second side wall 20 substantially parallel to and opposite the first side wall 18, a top wall 22 between the first side wall 18 and the second side wall 20, and a bottom wall 24 between the first side wall 18 and the second side wall 20 substantially parallel to and opposite the top wall 22. The main body 12 is preferably constructed from an aluminum material due to its strength and low weight and manufactured by a machining process. It is within the scope of the present invention, however, to construct the main body 12 from other materials including, but not limited to, other metals, plastic, etc., and to manufacture the main body in other manners.

Figure 2:
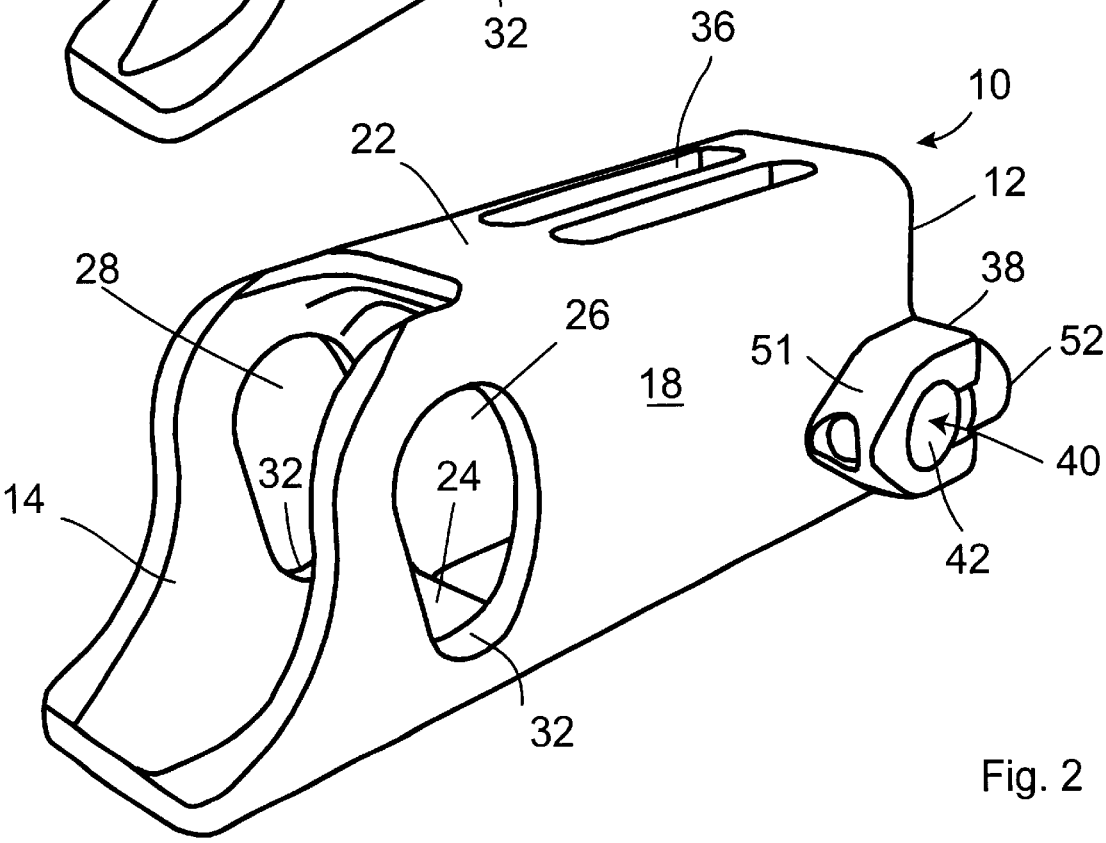
FIG. 2 is a front perspective view illustrating a belay/rappel device, constructed in accordance with the present invention, for use with a double rope.
Figure 3:
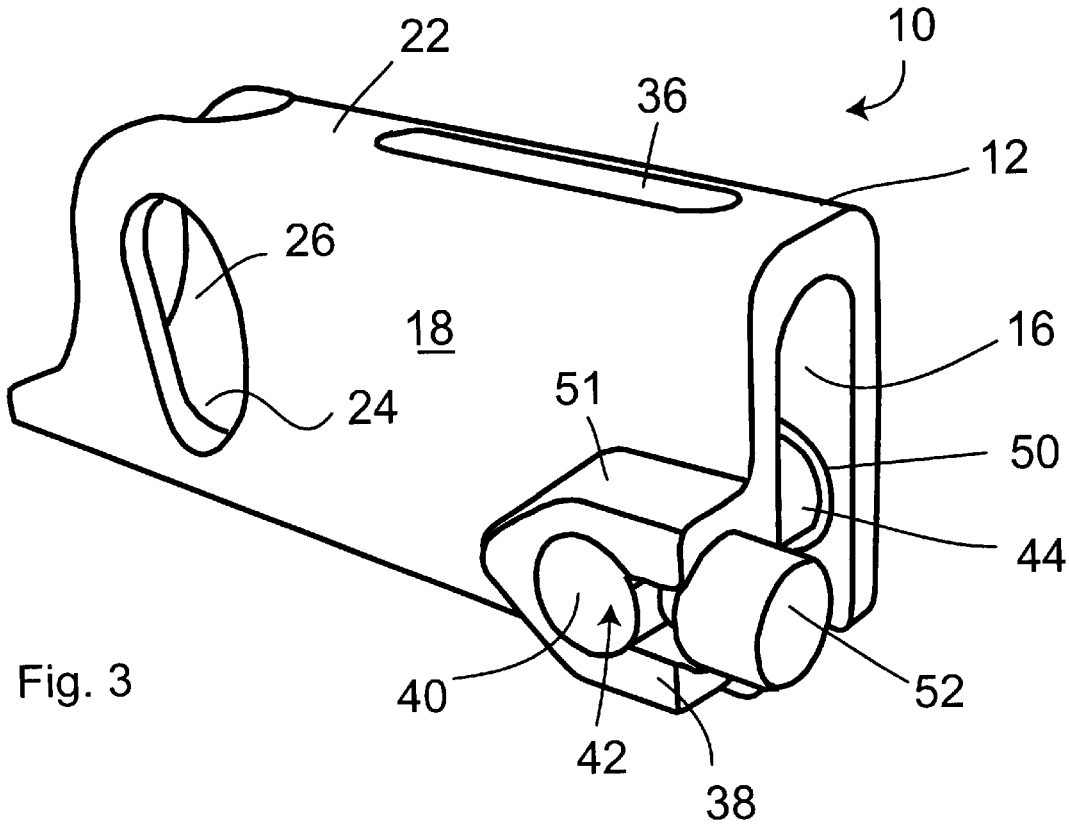
FIG. 3 is a rear perspective view illustrating the belay/rappel device of FIG. 1, constructed in accordance with the present invention, for use with a single rope.
Figure 4:
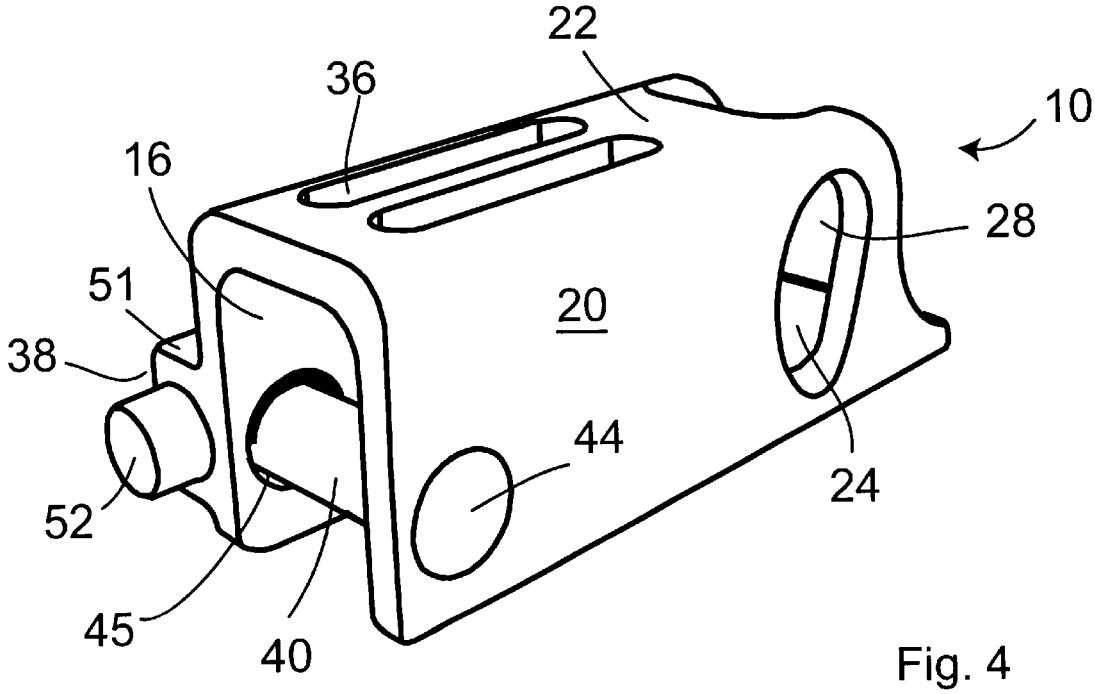
FIG. 4 is a rear perspective view illustrating the belay/rappel device of FIG. 2, constructed in accordance with the present invention, for use with a double rope.

The open front end 14 of the main body 12 of the belay/rappel device 10 preferably has a curved configuration, as best illustrated in FIGS. 1 and 2. This curved feature creates a surface variation that can be used to control the speed of the rope when the belay/rappel device 10 is in the released position by means of friction. A first carabiner opening 26 is formed in the first side wall 18 and a second carabiner opening 28 is formed in the second side wall 20 nearingly adjacent the open front end 14 of the main body 12 with the first carabiner opening 26 being substantially aligned with the second carabiner opening 26. The first carabiner opening 26 and the second carabiner opening 28 are sized and shaped for receiving a carabiner 30 and taper to a narrow portion 32 adjacent the bottom wall 24 for pinching a rope 34 in the locked position during climbing activities. Actual operation of the belay/rappel device 10 will be described in further detail below.

The bottom wall 24 of the main body 12 of the belay/rappel device 10 of the present invention preferably extends from the open front end 14 to a point at or past the first carabiner opening 26 and the second carabiner opening 28. The intersection between the bottom wall 24 and the first side wall 18 and the second side wall 20 is preferably curved allowing the rope 34 to slide freely along the bottom wall 24 when the belay/rappel device 10 is in the released position. The top wall 22 of the main body 12 preferably extends from approximately the first carabiner opening 26 and the second carabiner opening 28 to the open back end 16 of the main body 12. At least one slot 36 can be formed in the top wall 22 of the main body 12 to reduce the weight of the belay/rappel device 10.

The belay/rappel device 10 of the present invention further includes a rope securement mechanism 38 for securing the rope 34 within the main body 12. In a preferred embodiment, the rope securement mechanism 38 comprises a slidable pin 40 having a first end 42 and a second end 44. The first end 42 of the slidable pin 40 is positioned within a tapered first aperture 45 formed in the first side wall 18 and the second end 44 of the slidable pin 40 is positioned within a second aperture formed in the second side wall 20. Preferably, the second end 44 of the slidable pin 40 has an annular shoulder 50 portion receivable within the second aperture. The slidable pin 40 is slidable between the first aperture and the second aperture to the extent of the annular shoulder portion 50 contacting the tapered first aperture to maintain the slidable pin 40 to the main body 12. A collar 51 on the first side wall 18 receives a screw mechanism 52 which releasably secures the slidable pin 40 in position such that the rope 34 is secured about the slidable pin 40. Actual assembly of the belay/rappel device 10 with the rope 34 looped about the rope securement mechanism 38 will be discussed in further detail below.

Figure 15:
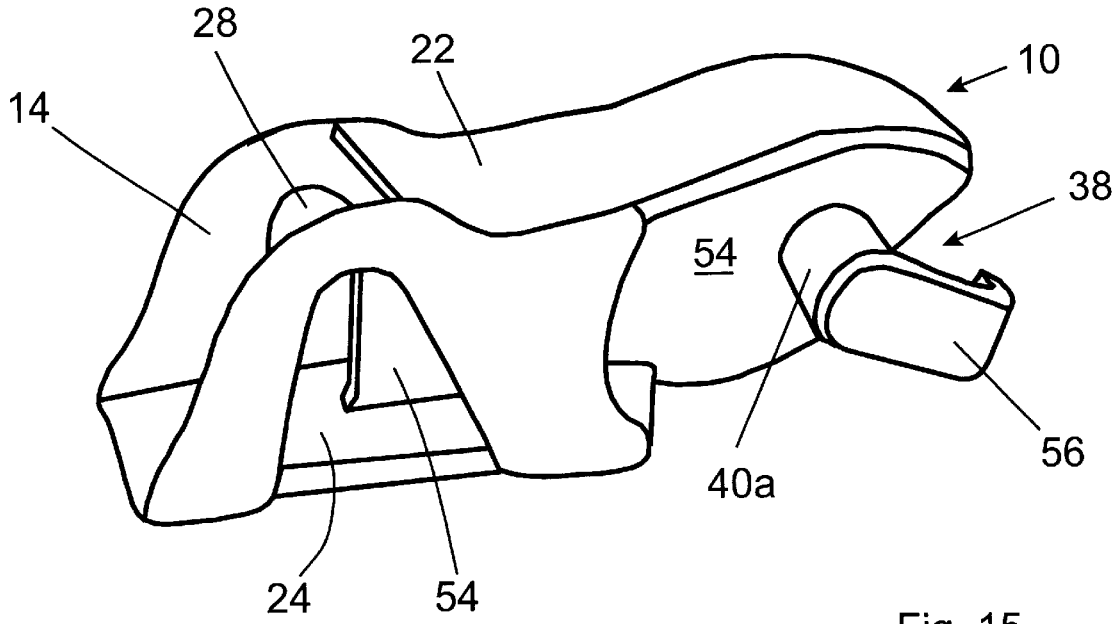
FIG. 15 is a perspective view illustrating another embodiment of the belay/rappel device, constructed in accordance with the present invention.

As illustrated in FIG. 15, in another embodiment of the belay/rappel device 10 of the present invention, the rope securement mechanism 38 is a fixed pin 40*a* extending from a center wall 54 with a tab 56 for maintaining the rope 34 in position about the fixed pin 40*a*. For the double rope configuration, a fixed pin 40*a* extends outward from the center wall 54 in each direction with one rope 34 looped about each fixed pin 40*a*.

Figure 16:
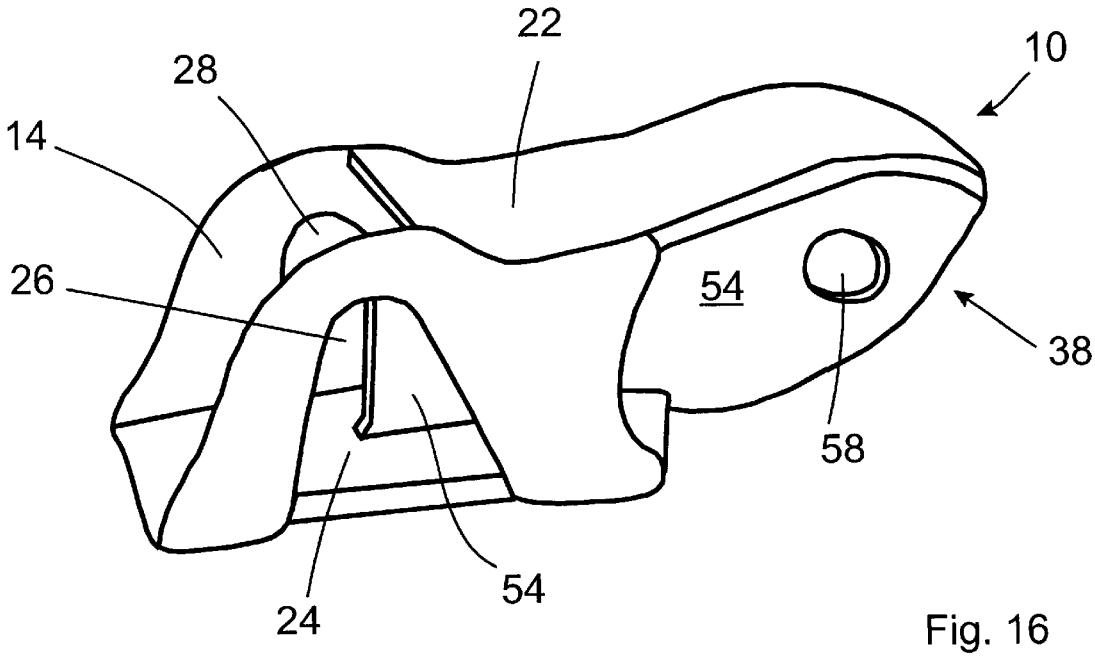
FIG. 16 is a perspective view illustrating still another embodiment of the belay/rappel device, constructed in accordance with the present invention.

As illustrated in FIG. 16, in still another embodiment of the belay/rappel device 10 of the present invention, the rope securement mechanism 38 consists of a carabiner (not shown) positioned within an aperture 58 formed in the center wall 54. The rope 34 is looped about the carabiner in a similar manner to the other embodiments.

As illustrated in FIGS. 17, 18, and 19, in yet another embodiment of the belay/rappel device 10 of the present invention, the rope securement mechanism 38 is a fixed pin (not shown) extending from the center wall 54 with an extended portion 60 extending therefrom. The extended portion 60 further maintains the rope 34 in position about the fixed pin and has an aperture 62 for receiving a carabiner 30. For the double rope configuration, a fixed pin extends outward from the center wall 54 in each direction with one rope 34 looped about each fixed pin. It should be noted that the carabiner 30 can be inserted either above or below the ropes depending on the desires of the user.

Figure 20:
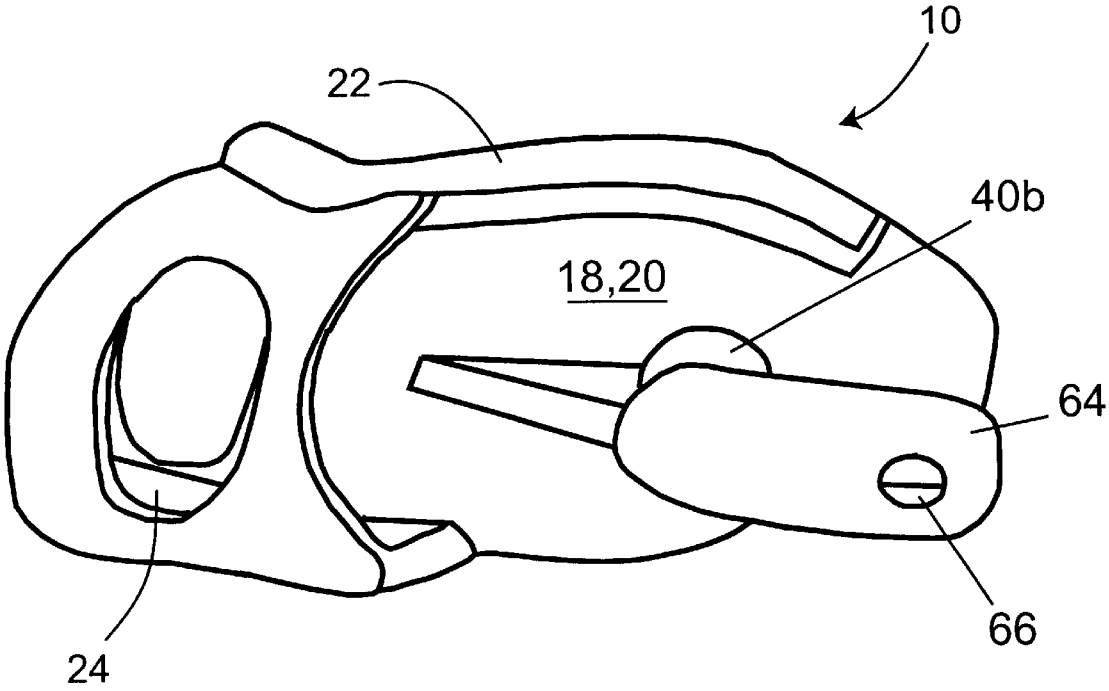
FIG. 20 is a perspective view illustrating still yet another embodiment of the belay/rappel device, constructed in accordance with the present invention.

As illustrated in FIG. 20, in still yet another embodiment of the belay/rappel device 10 of the present invention, the rope securement mechanism 38 is a fixed pin 40*b* extending from one of the side walls 18, 20 with an extended portion 64 extending therefrom. The extended portion 64 further maintains the rope 34 in position about the fixed pin 40*b* and has an aperture 66 for receiving a carabiner (not shown).

From the above discussion, the pin of the rope securement mechanism 38 has been described as having a slidable pin 40 and a fixed pin 40*a*, 40*b*. It should be noted that the pin 40 of the rope securement mechanism 38 can also be removable and have a larger or smaller diameter than illustrated herein. Furthermore, instead of a pin 40, the rope securement mechanism 38 can have a wheel (not shown) or other rotating mechanism upon which the rope 34 is looped. Ball bearings (not shown) or the like can be incorporated into the wheel or other rotating mechanism to assist in the rotation thereof.

The construction and operation of the belay/rappel device 10 of the present invention will now be described in detail. While a particular manner or construction and operation of the belay/rappel device 10 will be described, a person skilled in the art will understand that there are different constructions and operations are within the scope of the present invention.

Referring to FIG. 11, to assemble the belay/rappel device 10 for use in climbing activities and the like, the climber first releases the screw mechanism 52 of the rope securement mechanism 38. Next, the slidable pin 40 is moved toward the first side wall 18 until the annular shoulder portion 50 contacts the tapered first aperture 45 in the first side wall 18 thereby stopping the movement of the slidable pin 40. The rope 34 is pinched or folded upon itself creating a first rope strand 68, a second rope strand 70, and a looped portion 72. The looped portion 72 of the rope 34 is inserted into the main body 12 through the open front end 14 until the looped portion 72 extends from the open back end 16 of the main body 12.

Some climbers desire to use two ropes for safety reasons. When using two ropes 34, each rope 34 is pinched or folded and the looped portions 72 of both ropes 34 are inserted into the main body 12, as described above. When using an embodiment of the belay/rappel device 10 having a center wall 54, the rope 34 is positioned along one side of the center wall 54; for use with two ropes 34, the first rope 34*a* is positioned along one side of the center wall 54 and the second rope 34*b* is positioned along the other side of the center wall 54.

Now referring to FIG. 12, the slidable pin 40 is moved back toward the second side wall 20 within the looped portion 72 of the rope 34 until the annular shoulder portion 50 of the slidable pin 40 is seated within the second aperture. The screw mechanism 52 is then tightened thereby releasably securing the rope 34 about the slidable pin 40. The carabiner 30 is then inserted into both the first carabiner opening 26 and the second carabiner opening 28 in the first side wall 18 and the second side wall 20, respectively, of the main body 12. Preferably, the carabiner 30 is a locking carabiner to insure that the carabiner 30 remains in the desired position. Furthermore, the carabiner 30 should be sized and shaped such that the carabiner 30 will fit through both the first carabiner opening 26 and the second carabiner opening 28 of the first side wall 18 and the second side wall 20, respectively, of the main body 12.

In the preferred assembled configuration, the first rope strand 68 of the rope 34 extends from the open front end 14 of the main body 12 with the carabiner 30 positioned over the first rope strand 68 of the rope 34 thereby positioning the first rope strand 68 between the carabiner 30 and the bottom wall 24 of the main body 12. The second rope strand 70 of the rope 34 also extends from the open front end 14 adjacent the top wall 22 of the main body 12.

The carabiner 30 is attached to the climber, preferably to his or her harness (not shown), during the climbing activity. During the climbing activity, the climber holds the first rope strand 68 of the rope 34 in one of his or her hands with the other hand on the belay/rappel device 10 or the second rope strand 70. Use of the belay/rappel device 10 of the present invention being secured to the climber will now be described.

Figure 13:
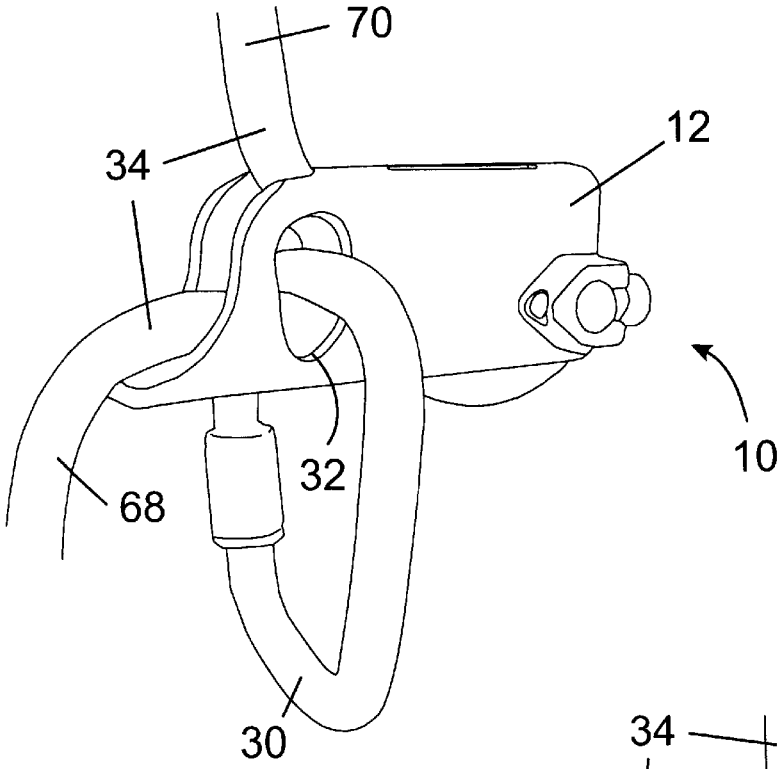
FIG. 13 is a perspective view illustrating the belay/rappel device of FIG. 1, constructed in accordance with the present invention, with the belay/rappel device being in the locked position.
Figure 14:
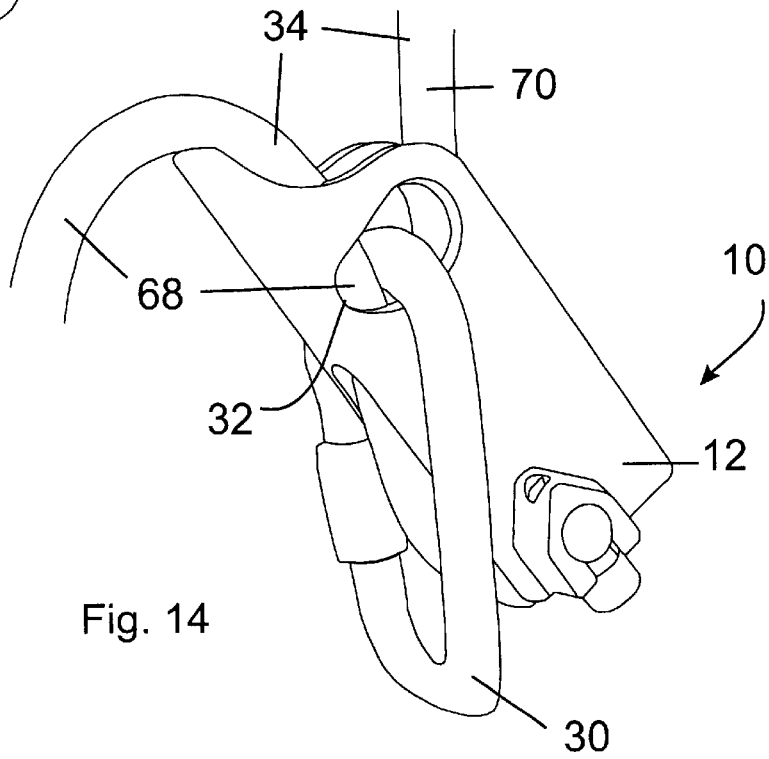
FIG. 14 is a perspective view illustrating the belay/rappel device of FIG. 1, constructed in accordance with the present invention, with the belay/rappel device being in the released position.

As illustrated in FIGS. 13 and 14, the belay/rappel device 10 of the present invention has a locked position and a released position. As illustrated in FIG. 13, during operation, with no outside influence from the climber, the belay/rappel device 10 remains in the locked position thereby allowing a climber to maintain his or her position without having to hold him or herself to the rope 34. In the locked position, the weight of the climber on the carabiner 30 causes the carabiner 30 to cinch the first rope strand 68 of the rope 34 against the narrow portion 32 of the first carabiner opening 26 and the second carabiner opening 28. This is a desired result in that if the climber were somehow incapacitated during the climbing activity, or has to do other things with his or her hands, the climber would be secure from falling.

As illustrated in FIG. 14, with one hand on the first rope strand 68 (slack rope portion) of the rope 34 and the other hand on the belay/rappel device 10, the climber can cause the belay/rappel device 10 to move into the released position by moving the open back end 16 of the main body 12 in a generally downward direction or the open front end 14 of the main body 12 in a generally upward position. In the released position, the rope 34 is free to travel through the main body 12 about the slidable pin 40 thereby allowing the climber to descend in a controlled manner. The more the main body 12 is moved away from the locked position, the faster the rope 34 will be released through the main body 12 about the slidable pin 40 and the faster the climber will descend. Completely releasing the main body 12 allows the belay/rappel device 10 to automatically move into the locked position.

When climbing alone, or belaying ones self, the belay/rappel device 10 of the present invention should be used in the same way as stated above. During climbing alone, it is necessary to stop and take up the rope slack as much possible to put less force on the belay/rappel device 10. During a fall when climbing alone, the belay/rappel device 10 will lock and hold the climber in position. At this point, the climber can either continue climbing up or rappel back down.

The belay/rappel device 10 of the present invention can be used and applied in a variety of situations. On a worksite, one could easily rappel down to the work area, stop, and begin working immediately without having to deal with locking or tying off. One can also lower extremely heavy tools and objects with ease by tying off the belay/rappel device 10 to a solid anchor. In a rescue situation, where a life is in danger and time is crucial, the belay/rappel device can be set up quickly and easily thereby allowing the rescue workers to reach the victim in a shorter amount of time.

Many different sizes, shapes, and molds can be constructed to construct the belay/rappel device 10 of the present invention. Basically, the belay/rappel device allows the rope 34 to be looped about the pin 40 and clamping the rope strand 68 with the carabiner 30 thereby providing a one-piece design.

The advantages of the belay/rappel device 10 present invention are as follows:

- provides a solid climbing tool without any moving parts for a lightweight, high strength product that is economical to produce;
- provides a climbing tool that automatically locks without the use of levers, cams, and wedges;
- provides a climbing tool usable in belaying or rappelling when climbing;
- provides a climbing tool that can be used with a single rope or with more than one rope;
- provides a climbing tool having a smooth transformation from the released position to the locked position when rappelling or belaying;
- provides a climbing tool that works well with most size climbing and mountaineering ropes;
- provides a climbing tool that can be manufactured to accommodate various sizes of ropes;
- provides a climbing tool with increased strength and durability to last longer than other climbing tools; and
- provides a climbing tool that can be used by all climbers, including beginner climbers.

Additional advantages of the belay/rappel device 10 of the present invention are the one-piece design, small size, and ease of handling. When in use, ice, dirt, and water have little effect on the performance of the belay/rappel device 10 due to the fact that there are no little parts for the adverse environmental elements to interfere. In fact, when more weight is applied, such as "body weight" or "catching a fall", the stronger the belay/rappel device 10 will lock the rope.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. A device for controlling the movement along at least one rope, the rope foldable to form a first rope strand, a second rope strand, and a looped portion between the first rope strand and the second rope strand, the device comprising:

a main body having an open first end and an open second end;

rope securement means adjacent the open second end for retaining the looped portion of the rope, the rope slidable about the rope securement means and the first rope strand and the second rope strand adapted to extend through the open first end;

a carabiner; and at least one carabiner opening formed in the main body for receiving the carabiner, the first rope strand being positioned between the carabiner and the main body;

wherein the main body is rotatable to a released position allowing the rope to slide about the rope securement means through the main body and upon release of the main body, the main body rotates to a locked position in response to tension between the first rope strand and the second rope strand, with the carabiner pinching the first rope strand against the main body inhibiting movement of the rope relative to the main body.

2. The device of claim 1 wherein the main body has a first side wall and a second side wall opposite the first side wall, and further comprising:

a first carabiner opening formed in the first side wall; and a second carabiner opening formed in the second side wall;

wherein the carabiner is receivable within the first carabiner opening and the second carabiner opening adapted to be positioned over the first rope strand of the rope.

3. The device of claim 2 wherein the first carabiner opening and the second carabiner opening have a narrow portion, the carabiner seatable within the narrow portion.

4. The device of claim 1 wherein the rope securement means is selected from the group consisting of a fixed pin, a slidable pin, and a rotatable wheel mechanism.

5. The of claim 4 wherein the rope securement means is a slidable pin, the main body having a first side wall and a second side wall opposite the first side wall, and further comprising:

a first aperture formed in the first side wall adjacent the open second end of the main body;

a second aperture formed in the second side wall adjacent the open second end of the main body and aligned with the first aperture;

wherein the slidable pin slides between the first aperture and the second aperture for securing the looped portion of the rope thereon.

6. The device of claim 5 and further comprising:

a screw mechanism for releasably securing the slidable pin between the first aperture and the second aperture.

7. The device of claim 5 wherein the slidable pin has a first end and a second end, the second end having an annular shoulder receivable within the second aperture, at least a portion of the diameter of the first aperture being less than the diameter of the shoulder.

8. The device of claim 7 and further comprising:

a collar on the first side wall of the main body, the first end of the slidable pin receivable within the collar; and a screw threaded through the first end of the slidable pin and receivable within an aperture in the collar.

9. A climbing system for controlling the ascent and descent of a climber, the climbing system comprising:

at least one rope;

at least one carabiner;

a frame member having at least one opening for receiving the carabiner, the frame member rotatable from a locked position to a released position;

a pin extending from the frame member, the rope looped about the pin;

wherein in the locked position, the rope is restrained between the carabiner and the frame member;

wherein in the released position, the rope is free to move through the frame member about the pin, the frame member rotating to the locked position upon release of the frame member.

10. The climbing system of claim 9 wherein the frame member is an enclosed body having an open first end and an open second end.

11. The climbing system of claim 10 wherein the enclosed body has a first side wall and a second side wall opposite the first side wall, and further comprising:

a first carabiner opening formed in the first side wall; and a second carabiner opening formed in the second side wall;

wherein the carabiner is simultaneously receivable within the first carabiner opening and the second carabiner opening adapted to be positioned over a first rope strand of the rope.

12. The climbing system of claim 10 wherein the enclosed body has a first side wall and a second side wall opposite the first side wall, the pin slidable between the first side wall and the second side wall, and further comprising:

a first aperture formed in the first side wall adjacent the open second end of the enclosed body;

a second aperture formed in the second side wall adjacent the open second end of the enclosed body and aligned with the first aperture;

wherein the slidable pin slides between the first aperture and the second aperture for receiving a looped portion of the rope.

13. The climbing system of claim 12 and further comprising:

a screw mechanism for releasably securing the slidable pin between the first aperture and the second aperture.

14. The climbing system of claim 13 wherein the slidable pin has a first end and a second end, the second end having an annular shoulder receivable within the second aperture, at least a portion of the diameter of the first aperture being less than the diameter of the shoulder.

15. The climbing system of claim 12 and further comprising:

a collar on the first side wall of the main body, the first end of the slidable pin receivable within the collar; and a screw threaded through the first end of the slidable pin and receivable within an aperture in the collar.

16. A method for inhibiting a climber from falling during a climbing activity, the method comprising:

providing at least one rope;

providing at least one carabiner;

providing a climbing device;

securing a looped portion of the rope with the climbing device, the rope slidable through the climbing device;

attaching the carabiner to the climbing device over the rope;

applying a force to the carabiner in a direction generally away from the climbing device;

locking movement of the rope through the climbing device with the carabiner;

rotating the climbing device thereby moving the carabiner relative to the rope and allowing the rope to freely slide through the climbing device; and releasing the climbing device to rotate the climbing device thereby locking movement of the rope through the climbing device.

17. The method of claim 16 and further comprising:

inserting two ropes into the climbing device.

18. The method of claim 16 wherein the climbing device has a first side wall and a second side wall opposite the first side wall, and further comprising:

forming a first carabiner opening in the first side wall; and forming a second carabiner opening in the second side wall;

inserting the carabiner into the first carabiner opening and the second carabiner opening.

19. The method of claim 16 and further comprising:

providing a slidable pin within the climbing device; and sliding the pin about a looped portion of the rope.

20. The method of claim 16 and further comprising:

releasably securing the pin in position.

* * * * *